US010405410B2

(12) United States Patent
Ando et al.

(10) Patent No.: US 10,405,410 B2
(45) Date of Patent: Sep. 3, 2019

(54) LUMINAIRE AND LIGHTING SYSTEM

(71) Applicant: Panasonic Intellectual Property Management Co., Ltd., Osaka (JP)

(72) Inventors: Tamotsu Ando, Osaka (JP); Tatsumi Setomoto, Osaka (JP); Kohji Hiramatsu, Osaka (JP); Hajime Ozaki, Kyoto (JP); Tomokazu Yamamoto, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/901,669

(22) Filed: Feb. 21, 2018

(65) Prior Publication Data

US 2018/0249560 A1 Aug. 30, 2018

(30) Foreign Application Priority Data

Feb. 24, 2017 (JP) ..... 2017-034099

(51) Int. Cl.

| | |
|---|---|
| ***H05B 37/02*** | (2006.01) |
| ***F21S 8/04*** | (2006.01) |
| ***F21V 17/16*** | (2006.01) |
| ***F21V 21/15*** | (2006.01) |
| ***F21V 21/26*** | (2006.01) |
| ***F21V 23/00*** | (2015.01) |
| ***F21V 23/06*** | (2006.01) |
| ***F21V 21/002*** | (2006.01) |
| ***F21V 21/03*** | (2006.01) |
| ***F21V 21/14*** | (2006.01) |
| ***F21V 23/04*** | (2006.01) |
| *F21Y 115/10* | (2016.01) |

(Continued)

(52) U.S. Cl.

CPC ..... *H05B 37/0272* (2013.01); *F21S 8/043* (2013.01); *F21V 17/16* (2013.01); *F21V 21/002* (2013.01); *F21V 21/03* (2013.01); *F21V 21/14* (2013.01); *F21V 21/15* (2013.01); *F21V 21/26* (2013.01); *F21V 23/001* (2013.01); *F21V 23/0435* (2013.01); *F21V 23/06* (2013.01); *F21V 3/0615* (2018.02); *F21Y 2115/10* (2016.08); *H05B 33/0845* (2013.01)

(58) Field of Classification Search

None

See application file for complete search history.

(56) References Cited

U.S. PATENT DOCUMENTS 6,655,817 B2 * 12/2003 Devlin ..... F21V 21/15 362/233

2010/0020550 A1 1/2010 Kawashima et al.

(Continued)

FOREIGN PATENT DOCUMENTS

JP 2007-179411 A 7/2007

JP 2009-231085 A 10/2009

(Continued)

*Primary Examiner* — Elmito Breval

(74) *Attorney, Agent, or Firm* — McDermott Will & Emery LLP

(57) ABSTRACT

Luminaire includes: lighting apparatus which includes a wireless communication circuit and a light emitter of which a light emitting state is controlled based on a control signal received by the wireless communication circuit; and an apparatus body to which the lighting apparatus is detachably attached in different orientations.

14 Claims, 13 Drawing Sheets

(51) Int. Cl.
*F21V 3/06* (2018.01)
*H05B 33/08* (2006.01)

(56) References Cited

U.S. PATENT DOCUMENTS

2012/0286673 A1* 11/2012 Holland ..... H05B 33/0854 315/155
2012/0306377 A1 12/2012 Igaki et al.
2013/0033195 A1* 2/2013 Liao ..... F21S 9/032 315/294
2013/0065642 A1* 3/2013 Liu ..... G08C 17/02 455/557
2013/0334969 A1* 12/2013 Ishikita ..... H05B 37/0272 315/129
2014/0015421 A1 1/2014 Mituyasu et al.
2014/0028210 A1* 1/2014 Maxik ..... F21V 23/06 315/200 R
2014/0049164 A1* 2/2014 McGuire ..... H05B 33/08 315/149
2014/0049963 A1* 2/2014 McGuire ..... F21V 19/04 362/249.01
2014/0049971 A1* 2/2014 McGuire ..... F21V 23/003 362/382
2014/0306619 A1* 10/2014 Yokosawa ..... H05B 37/0272 315/291
2014/0368116 A1* 12/2014 Walters ..... H05B 37/0272 315/152
2015/0285479 A1 10/2015 Igaki et al.
2016/0091148 A1* 3/2016 Leung ..... F21S 8/026 362/222
2016/0262245 A1* 9/2016 Ando ..... F21S 8/026
2017/0278383 A1* 9/2017 Dimberg ..... G01D 5/02

FOREIGN PATENT DOCUMENTS

JP 2010-033816 A 2/2010
JP 2013-033717 A 2/2013
JP 2014-17184 A 1/2014

* cited by examiner

LUMINAIRE AND LIGHTING SYSTEM

CROSS REFERENCE TO RELATED APPLICATION

This application claims the benefit of priority of Japanese Patent Application Number 2017-034099 filed on Feb. 24, 2017, the entire content of which is hereby incorporated by reference.

BACKGROUND

1. Technical Field

The present disclosure relates to a luminaire including an apparatus body and a lighting apparatus detachably attached to the apparatus body, and a lighting system including the luminaire.

2. Description of the Related Art

Luminaires having wireless communication functions are conventionally known. For example, Japanese Unexamined Patent Application Publication No. 2007-179411 discloses a lighting device to which a wireless sensor is attached. The wireless sensor detects a state of the lighting device, and transmits a control request signal to a management device through a wireless communication network.

SUMMARY

According to the above-described conventional technique, the wireless sensor (wireless device) includes a main body which performs wireless communications and a clip which secures the main body to a fluorescent lamp included in the lighting device. In other words, the wireless device is included by the lighting device with the fluorescent lamp that is a light source being disposed between the wireless device and the lighting device. For that reason, there is a possibility that, for example, illumination light is blocked by the wireless device, and thus a desired lighting effect is not obtained. Furthermore, the wireless device is exposed to the outside, which is not desirable in terms of the external appearance. In view of the above, it is conceivable that the problem of blocking light or the like is solved by disposing the wireless device inside the lighting device. In this case, however, the position of the wireless device is fixed by fixing the lighting device to a ceiling, etc., resulting in a problem that, for example, it is difficult to improve a poor communication state between the wireless device and an external controller.

The present disclosure has been conceived by newly focusing on the above-described problem by the inventors. An object of the present disclosure is to provide a luminaire which includes a lighting apparatus having a wireless communication function and is capable of easily improving a communication state, and a lighting system including the luminaire.

A luminaire according to an aspect of the present disclosure includes: a lighting apparatus which includes a wireless communication circuit and a light emitter of which a light emitting state is controlled based on a control signal received by the wireless communication circuit; and an apparatus body to which the lighting apparatus is detachably attached in different orientations.

In addition, a lighting system according to an aspect of the present disclosure includes a luminaire, and a controller which transmits the control signal to the luminaire. In the lighting system, the controller includes: a control communicator which wirelessly communicates with the luminaire; and a determinator which outputs notification information indicating that an orientation of the lighting apparatus in the luminaire is to be changed, when a reception strength of a signal transmitted from the luminaire and received by the control communicator is less than a threshold.

With the luminaire including a lighting apparatus having a wireless communication function according to an aspect of the present disclosure, it is possible to easily improve a communication state. In addition, with the lighting system according to an aspect of the present disclosure, it is possible to easily improve the communication state of the luminaire included by the lighting system.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

The following describes in detail a luminaire and the like according to embodiments of the present disclosure and variations thereof, with reference to the drawings. It should be noted that the embodiments and variations described below each indicate one specific example of the present disclosure. The numerical values, shapes, materials, structural components, the disposition and connection of the structural components, assembling sequence, etc. described in the following embodiments and variations are mere examples, and do not intend to limit the present disclosure. Furthermore, among the structural components in the following embodiments and the variations, structural components not recited in the independent claims each of which indicates the broadest concept of the present disclosure are described as arbitrary structural components.

In addition, each diagram is a schematic diagram and not necessarily strictly illustrated. Accordingly, for example, scale sizes, etc., are not necessarily exactly represented. In each of the diagrams, substantially the same structural elements are assigned with the same reference signs, and redundant descriptions will be omitted or simplified.

The following describes a luminaire according to embodiments.

[Overall Configuration of Luminaire]

Figure 1:
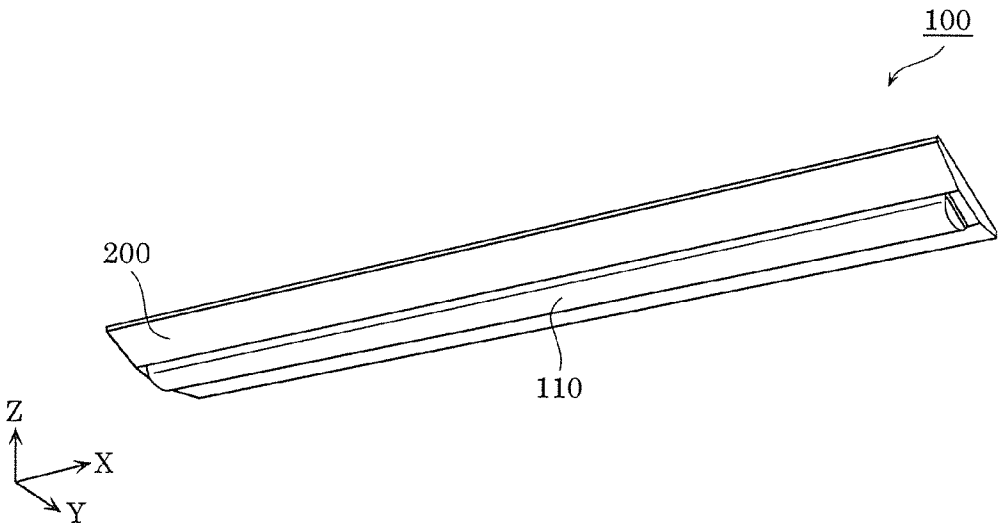
FIG. 1 is a perspective view which illustrates an external view of a luminaire according to an embodiment.
Figure 2:
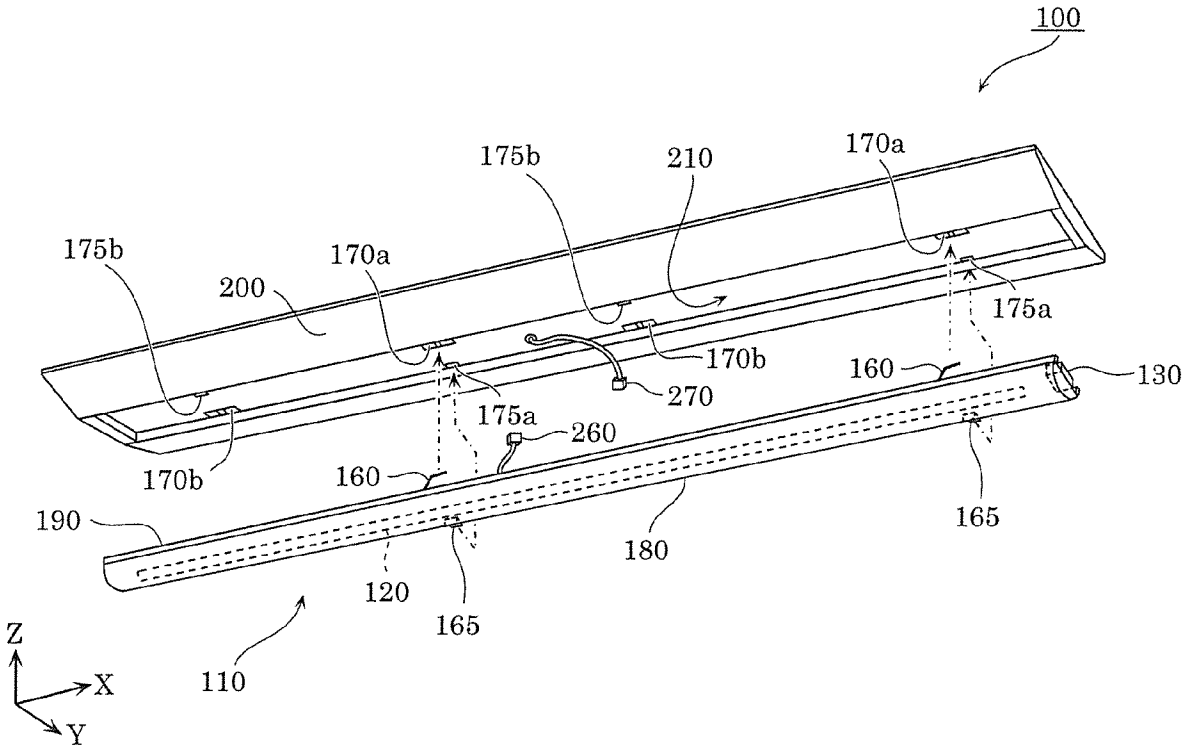
FIG. 2 is an exploded perspective view of the luminaire according to the embodiment.

First, the following describes a configuration of a luminaire according to an embodiment, with reference to FIG. 1 and FIG. 2.

FIG. 1 is a perspective views which illustrates an external view of luminaire 100 according to the embodiment. FIG. 2 is an exploded perspective view of luminaire 100 according to the embodiment.

As illustrated in FIG. 1 and FIG. 2, luminaire 100 according to the embodiment includes lighting apparatus 110 and apparatus body 200.

Apparatus body 200 is a base component of luminaire 100, and fixed to a ceiling, for example, by a bolt and a nut, etc. Apparatus body 200 includes recess 210 in which lighting apparatus 110 is embedded. According to the embodiment, lighting apparatus 110 is detachably attached to apparatus body 200. More specifically, a lighting-apparatus-side engage portion included in lighting apparatus 110 engages with an apparatus-body-side engage portion included in apparatus body 200, thereby detachably attaching lighting apparatus 110 to apparatus body 200.

According to the embodiment, lighting apparatus 110 includes two engaging claws 165 and two engaging springs 160. Engaging claw 165 and engaging spring 160 are each an example of the lighting-apparatus-side engage portion.

In the example illustrated in FIG. 2, the two engaging claws 165 respectively engage with engaging holes 175*a* defined in recess 210, and the two engaging springs 160 respectively engage with engaging holes 170*a* defined in recess 210, thereby attaching lighting apparatus 110 to apparatus body 200. It should be noted that each of the engaging holes, such as engaging holes 175*a*, included in apparatus body 200 is an example of an apparatus-body-side engage portion. A structure of attaching lighting apparatus 110 to apparatus body 200 will be described later in detail, with reference to FIG. 3A to FIG. 4B.

Connector 270 is disposed at an end of a power line extending from apparatus body 200, and connector 260 is disposed at an end of a power line extending from lighting apparatus 110. Power necessary for emitting light by lighting apparatus 110 is supplied from apparatus body 200 to lighting apparatus 110, by coupling connector 270 and connector 260.

Lighting apparatus 110 includes wireless communication circuit 130 and light emitter 120 which emits illumination light. A luminescent state (e.g., turning on, turning off, and dimming) of light emitter 120 is controlled on the basis of a control signal received by wireless communication circuit 130, for example. According to the embodiment, lighting apparatus 110 further includes cover 180 which covers light emitter 120.

Light emitter 120 is a light emitting module including a substrate and a plurality of light emitting elements arranged on the substrate. According to the embodiment, an LED element is employed as a light source of light emitter 120. Light emitter 120 will be described later in detail with reference to FIG. 3B, etc.

Cover 180 is a component which transmits light emitted by light emitter 120. In addition, according to the embodiment, cover 180 has a function of diffusing light emitted by light emitter 120. For example, a resin which contains a light diffuse material (fine particle) such as silica and calcium carbonate, or a white pigment is attached to an inner surface or an outer surface of cover 180 formed using transparent glass or a resin, thereby forming an opaque-white light diffusion film on cover 180.

It should be noted that, cover 180 need not necessarily have the function of diffusing light, and cover 180 may be transparent to the extent that the inside of cover 180 is viewable from the outside of cover 180. In addition, for example, when the entirety of light emitter 120 is sealed by light transmissive resin, cover 180 which covers light emitter 120 may be omitted.

Next, a structure of attaching lighting apparatus 110 to apparatus body 200 of lighting apparatus 110 according to the embodiment will be described with reference to FIG. 3A through FIG. 4B.

[Structure of Attaching Lighting Apparatus to Apparatus Body]

Figure 3A:
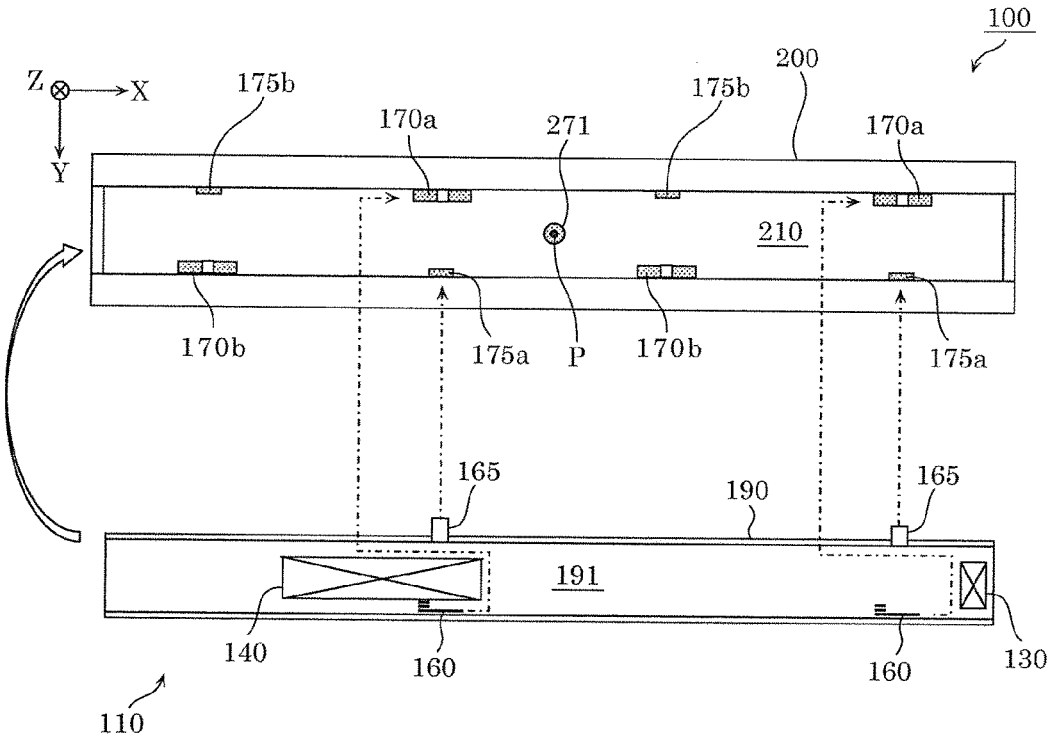
FIG. 3A is a first diagram which illustrates a structural relationship between a lighting apparatus and an apparatus body according to the embodiment.

FIG. 3A is a first diagram which illustrates a structural relationship between lighting apparatus 110 and apparatus body 200 according to the embodiment. FIG. 3A illustrates lighting apparatus 110 in a state in which lighting apparatus is detached from apparatus body 200, and rear surface 191 (the side which faces apparatus body 200 when attached to apparatus body 200) of lighting apparatus 110 faces toward the minus direction of axis Z. In addition, in FIG. 3A, a dotted pattern is applied to holes (openings) defined in apparatus body 200 for the purpose of easy discrimination from the other elements. These explanatory items regarding FIG. 3A described above are also applied to FIG. 4A which will be described later.

Figure 3B:
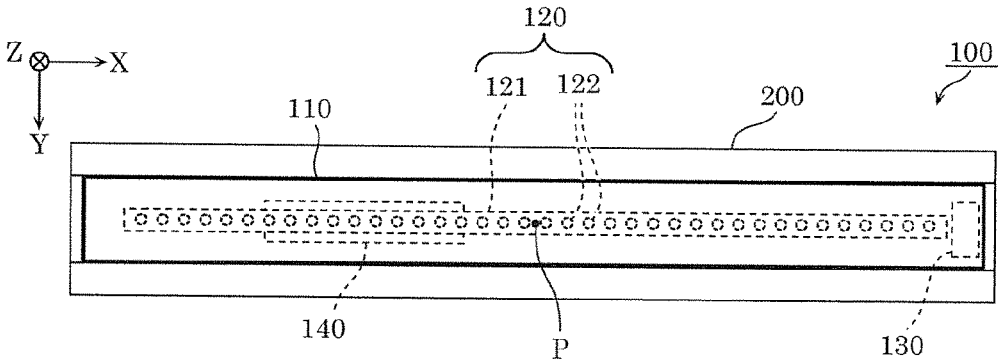
FIG. 3B is a first diagram which illustrates a configuration example of the luminaire according to the embodiment.

FIG. 3B is a first diagram which illustrates a configuration example of luminaire 100 according to the embodiment. More specifically, FIG. 3B is a plan view of luminaire 100 in the case where lighting apparatus 110 is attached to apparatus body 200 in the state illustrated in FIG. 3A. It should be noted that, structural components, such as light emitter 120, which are positioned inwardly with respect to cover 180 in a plan view are each illustrated by dashed lines for indicating their positions in luminaire 100. In addition, the outer shape of lighting apparatus 110 is indicated by a bold line for clarifying an area in which lighting apparatus 110 is present. These explanatory items regarding FIG. 3B described above are also applied to FIG. 4B which will be described later. It should be noted that the phrase "in a plan view" indicates the case where luminaire 100 is viewed from the side where cover 180 is disposed (from the minus side of axis Z), or the case where luminaire 100 is viewed from the direction of the normal line of substrate 121 of light emitter 120.

As illustrated in FIG. 3A, lighting apparatus 110 includes base 190 to which light emitter 120 (see FIG. 3B) is fixed, and driving circuit 140 and wireless communication circuit 130 are disposed on rear surface 191 of base 190.

Driving circuit 140, for example, converts AC power supplied from a commercial power supply to DC power for causing light emitter 120 to emit light, and supplies the DC power to light emitter 120. More specifically, driving circuit 140 receives a control signal from wireless communication circuit 130 via a signal line (not illustrated), and adjusts the amount of power supply to light emitter 120 or the like, according to the control signal. In this manner, the luminescent state of light emitter 120 is controlled. In addition, driving circuit 140 transmits a control result signal which indicates a result of control performed according to the control signal (turning on, turning off, a dimming rate after the control, etc.) to a source of transmission of the control signal via wireless communication circuit 130.

Wireless communication circuit 130 is a wireless communication module which receives a control signal for controlling light emitter 120 by performing wireless communication. A control signal is, for example, a wireless signal transmitted from a controller operated by a user (e.g., an owner of luminaire 100, a worker who installs luminaire 100, etc.). According to the embodiment, wireless communication circuit 130 has not only a receiving function but also a transmitting function as described above. It should be noted that wireless communication circuit 130 may be disposed on a front surface (the surface on which light emitter 120 is disposed) of base 190. However, disposing wireless communication circuit 130 on rear surface 191 of base 190 is advantageous because this reduces the possibility of occlusion of illumination light (blocking light) by wireless communication circuit 130.

Wireless communication is communication performed using radio waves (i.e., visible light and infrared light are excluded). Wireless communication circuit 130 performs wireless communication based on, for example, a wireless communication standard such as Wi-Fi (registered trademark), Bluetooth (registered trademark), ZigBee (registered trademark), etc., which are wireless communication standards belong to specified low power radio.

As illustrated in FIG. 3B, light emitter 120 includes substrate 121 and a plurality of light emitting elements 122 arranged on substrate 121. Each of the plurality of light emitting elements 122 is, for example, a packaged LED element including an LED chip. More specifically, the mounting configuration of light emitter 120 is a surface mount device (SMD) configuration in which a packaged LED element including an LED chip is mounted on substrate 121. It should be noted that, for example, when a blue LED chip is employed as an LED chip, the blue LED chip may be sealed by a sealant including a yellow phosphor such as yttrium aluminum garnet (YAG) which produces fluorescence using blue light emitted by the blue LED chip as excitation light, for obtaining white light.

Lighting apparatus 110 which has a configuration for generating illumination light as described above further has a configuration for detachably attaching lighting apparatus 110 to apparatus body 200. More specifically, lighting apparatus 110 includes two engaging claws 165 and two engaging springs 160, as described above. The two engaging claws 165 are disposed with an interval along the longitudinal direction (direction of axis X) of base 190 which has an elongate shape. As with the above, the two engaging springs 160 are disposed with an interval along the longitudinal direction (direction of axis X) of base 190 which has an elongate shape. In addition, the two engaging claws 165 are disposed on one of end portions (the minus side of axis Y, in FIG. 3A) of the crosswise direction (direction of axis Y) of base 190, and the two engaging springs 160 are disposed on the other of the end portions (the plus side of axis Y, in FIG. 3A). It should be noted that engaging springs 160 are each spring component called, for example, "torsion spring" or "torsion coil spring".

Lighting apparatus 110 having the above-described configuration is attached to apparatus body 200 according to the procedure described below, for example. First, two engaging claws 165 of lighting apparatus 110 are inserted into two engaging holes 175*a* of apparatus body 200. In other words, the two engaging claws 165 are caused to hook onto engaging holes 175*a*. Subsequently, connector 270 (not illustrated in FIG. 3A) at an end of the power line drawn out from opening portion 271 of apparatus body 200 and connector 260 (not illustrated in FIG. 3A) connected to driving circuit 140 are connected.

It should be noted that, according to the embodiment, opening portion 271 is located at the center of apparatus body 200 in a plan view. In other words, opening portion 271 is defined at a position at which a virtual axis (axis P) parallel to axis Z passes. The virtual axis (axis P) passes through the center of apparatus body 200 in a plan view. Needless to say, the position of defining opening portion 271 is not limited to the position at which axis P passes. For example, the position of defining opening portion 271 is determined, as appropriate, in consideration of ease of connecting connector 270 and connector 260 after a change in an orientation of lighting apparatus 110 which will be described later.

Then, lighting apparatus 110 is rotated in such a manner that rear surface 191 of base 190 faces apparatus body 200 in a state in which two engaging claws 165 respectively hook onto engaging holes 175*a*. Furthermore, a tip end of each of the two engaging springs 160 in a compressed state is inserted into a corresponding one of engaging holes 170*a* defined in apparatus body 200. Subsequently, lighting apparatus 110 is pressed toward apparatus body 200, causing the two engaging springs 160 to respectively engage with engaging holes 170*a*. More specifically, the two engaging springs 160 are placed in a released state in engaging holes 170*a* by elastic force (restoring force), thereby engaging with engaging holes 170*a*.

In this manner, according to the embodiment, when lighting apparatus 110 is attached to apparatus body 200, lighting apparatus 110 and apparatus body 200 are engaged at four positions, and as a result, lighting apparatus 110 is stably held by apparatus body 200. When lighting apparatus 110 is pulled toward a front side (the minus side of axis Z), the two engaging springs 160 are compressed due to elastic deformation, and pulled out respectively from engaging holes 170*a*. In this manner, it is possible to detach lighting apparatus 110 from apparatus body 200.

When lighting apparatus 110 and apparatus body 200 are combined as described above, wireless communication circuit 130 is located at a right end portion (an end portion in the plus side of axis X) of luminaire 100 in a plan view, as illustrated in FIG. 3B.

Here, in luminaire 100 according to the embodiment, a plurality of engaging holes are defined in apparatus body 200 which are not used in attaching of lighting apparatus 110 to apparatus body 200 in FIG. 3B. More specifically, as illustrated in FIG. 3A, two engaging holes 170*b* and two engaging holes 175*b* are further defined in apparatus body 200. The two engaging holes 170*b* are each shaped to enable engagement with engaging spring 160 of lighting apparatus 110, and the two engaging holes 175*b* are each shaped to enable engagement with engaging claw 165 of lighting apparatus 110.

When lighting apparatus 110 which is in a state illustrated in FIG. 3B is rotated about axis P by 180 degrees, the two engaging claws 165 are positioned to be engaged with the two engaging holes 175*b* of apparatus body 200, and the two engaging springs 160 are positioned to be engaged with the two engaging holes 170*b* of apparatus body 200. More specifically, lighting apparatus 110 is once detached from apparatus body 200, rotated by 180 degrees, and then attached to apparatus body 200 as illustrated in FIG. 4A and FIG. 4B.

Figure 4A:
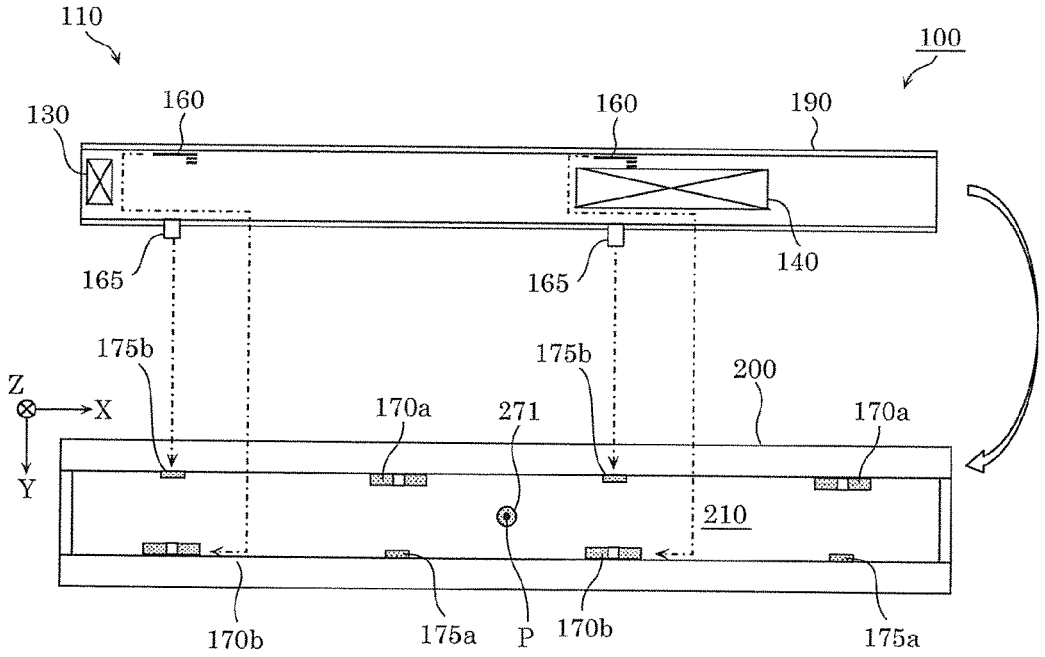
FIG. 4A is a second diagram which illustrates a structural relationship between the lighting apparatus and the apparatus body according to the embodiment.
Figure 4B:
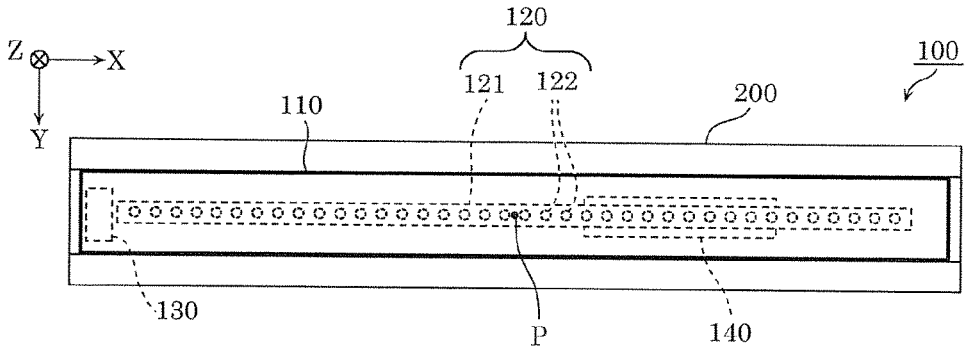
FIG. 4B is a second diagram which illustrates a configuration example of the luminaire according to the embodiment.

FIG. 4A is a second diagram which illustrates a structural relationship between lighting apparatus 110 and apparatus body 200 according to the embodiment. FIG. 4B is a second diagram which illustrates a configuration example of luminaire 100 according to the embodiment.

For example, two engaging claws 165 of lighting apparatus 110 are inserted into two engaging holes 175*b* of apparatus body 200, as illustrated in FIG. 4A. In other words, the two engaging claws 165 are caused to hook onto engaging holes 175*b*. Subsequently, connector 270 (not illustrated in FIG. 4A) at an end of a power line drawn out from opening portion 271 of apparatus body 200 and connector 260 (not illustrated in FIG. 4A) connected to driving circuit 140 are connected.

Then, lighting apparatus 110 is rotated in such a manner that rear surface 191 of base 190 faces apparatus body 200 in a state in which two engaging claws 165 hook onto engaging holes 175*b*. Furthermore, a tip end of each of the two engaging springs 160 in a compressed state is inserted into a corresponding one of engaging holes 170*b* defined in apparatus body 200. Subsequently, lighting apparatus 110 is pressed toward apparatus body 200, causing the two engaging springs 160 to respectively engage with engaging holes 170*b*. More specifically, the two engaging springs 160 are placed in a released state in engaging holes 170*b* by elastic force (restoring force), thereby engaging with engaging holes 170*b*.

In this manner, when lighting apparatus 110 is attached to apparatus body 200, lighting apparatus 110 and apparatus body 200 are engaged at four positions, and as a result, lighting apparatus 110 is stably held by apparatus body 200, in the same manner as the example illustrated in FIG. 3A and FIG. 3B. In addition, when lighting apparatus 110 is pulled toward the front side (the minus side of axis Z), the two engaging springs 160 are compressed due to elastic deformation, and pulled out respectively from engaging holes 170*b*. In this manner, it is possible to detach lighting apparatus 110 from apparatus body 200.

When lighting apparatus 110 and apparatus body 200 are combined as described above, wireless communication circuit 130 is located at a left end portion (an end portion in the minus side of axis X) of luminaire 100 in a plan view, as illustrated in FIG. 4B. In other words, the position of wireless communication circuit 130 in luminaire 100 is changed from the position illustrated in FIG. 3B (the right end portion in luminaire 100).

In this manner, luminaire 100 according to the embodiment includes wireless communication circuit 130 fixed to lighting apparatus 110, and the orientation of lighting apparatus 110 with respect to apparatus body 200 can be changed. With this configuration, it is possible to change the position of wireless communication circuit 130 in luminaire 100. Accordingly, in the case where luminaire 100 is disposed on a ceiling in the state illustrated in FIG. 3B, for example, when the communication between a controller fixed to a wall and luminaire 100 is in a poor state, there is a possibility that the communication state can be improved by placing luminaire 100 into the state illustrated in FIG. 4B; that is, by rotating lighting apparatus 110.

In addition, according to the embodiment, the plurality of light emitting elements 122 in light emitter 120 are arranged so as to be rotationally symmetric. More specifically, according to the embodiment, it is possible to change the orientation of lighting apparatus 110 by every 180 degrees in a direction of rotation about axis P passing through the center in a plan view. In this case, the plurality of light emitting elements 122 are arranged at positions that are rotationally symmetric by every 180 degrees about axis P. Accordingly, comparing the case illustrated in FIG. 3B and the case illustrated in FIG. 4B, lighting effects (distribution of illumination light, etc.) when luminaire 100 is on are substantially identical. In other words, it is possible to improve the communication state between luminaire 100 and other device without changing illumination space created by luminaire 100.

The following describes a lighting system which includes luminaire 100 having the above-described configuration and a controller that controls luminaire 100, with reference to FIG. 5 to FIG. 9C.

(Lighting System)

Figure 5:
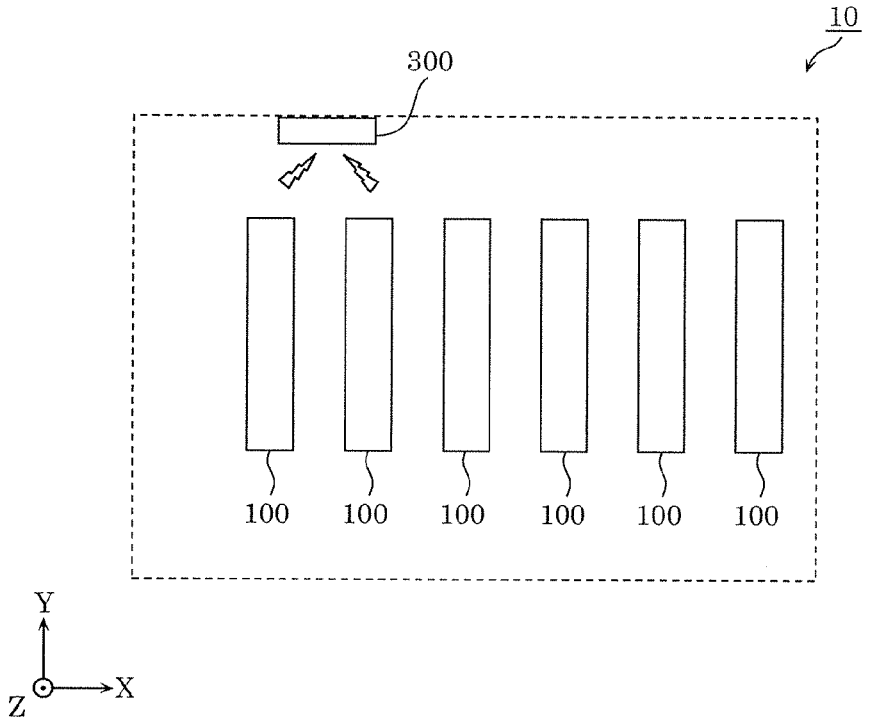
FIG. 5 is a plan view which illustrates a schematic configuration of a lighting system according to the embodiment.
Figure 6:
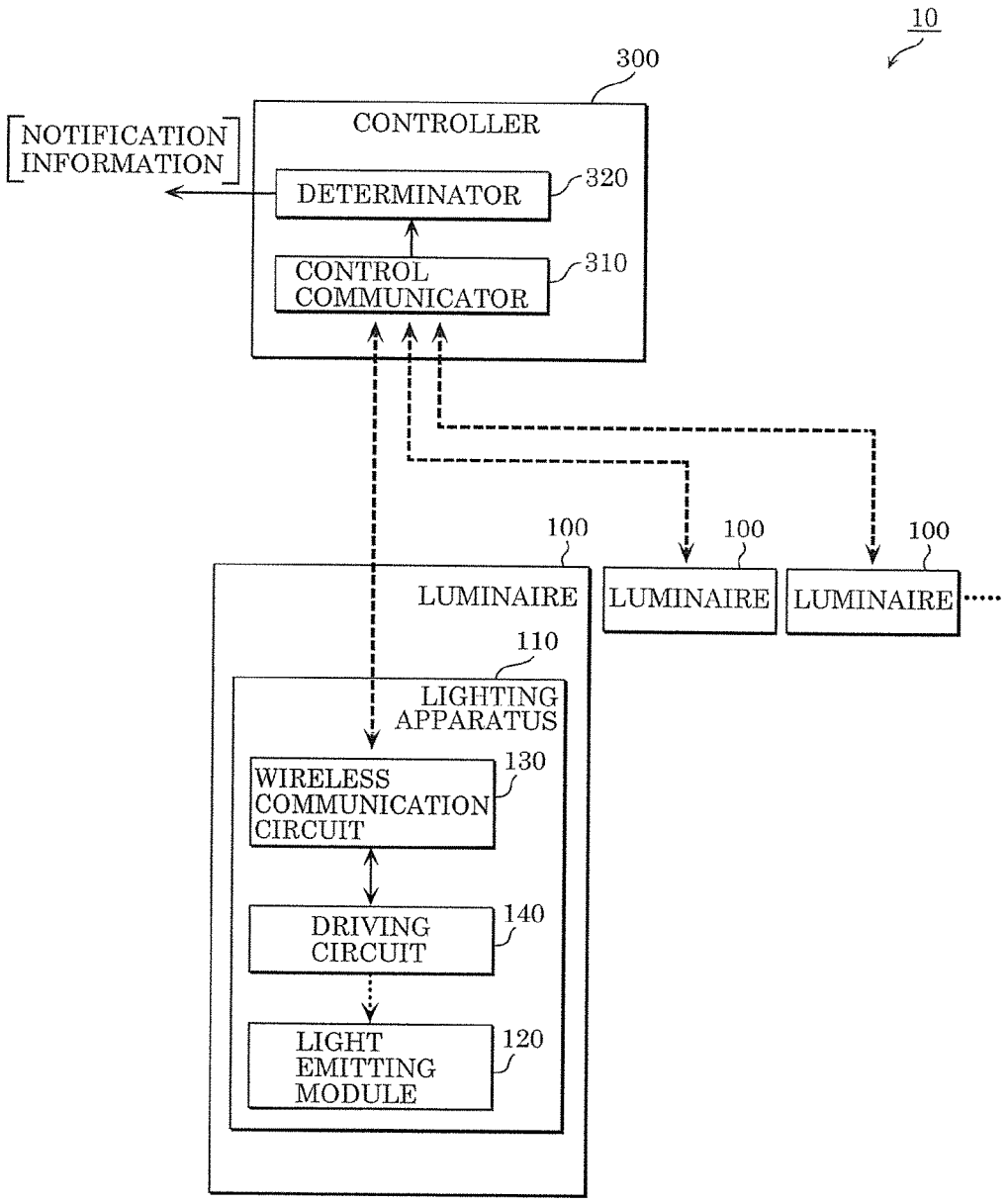
FIG. 6 is a block diagram which illustrates a schematic configuration of a controller and the luminaire according to the embodiment.

FIG. 5 is a plan view which illustrates a schematic configuration of lighting system 10 according to the embodiment. It should be noted that, in FIG. 5, a layout of lighting system 10 when a room in which lighting system 10 is installed is viewed from above is schematically illustrated. In addition, an outer shape of the room in a plan view is indicated by a dashed line defining a rectangle. FIG. 6 is a block diagram which illustrates a schematic configuration of controller 300 and luminaire 100 according to the embodiment.

As illustrated in FIG. 5, lighting system 10 includes luminaire 100 and controller 300 which transmits a control signal to luminaire 100. More specifically, lighting system 10 is provided with a plurality of luminaires 100 (six luminaires according to the embodiment), and each of luminaires 100 is capable of wirelessly communicating with controller 300 using wireless communication circuit 130.

As illustrated in FIG. 6, controller 300 includes control communicator 310 which wirelessly communicates with luminaire 100, determinator 320. It should be noted that controller 300 is implemented as an operation panel which is installed on an interior wall, for example. More specifically, controller 300 has, as a basic function, a function of transmitting a control signal for turning on, turning off, dimming, etc. each of the plurality of luminaires 100 according to an instruction by a user, for example, from control communicator 310 to each of the plurality of luminaires 100. In addition, controller 300 has a function of receiving a signal such as a control result signal, etc. transmitted from each of the plurality of luminaires 100. It should be noted that controller 300 may include, as a user interface, a display panel, a button, etc., which are not illustrated.

Determinator 320 included by controller 300 compares a reception strength of the signal transmitted from luminaire 100 with a threshold, and outputs information according to a result of the comparing. More specifically, when the reception strength of the signal transmitted from luminaire 100 is less than the threshold, determinator 320 outputs notification information indicating that the orientation of lighting apparatus 110 of luminaire 100 is to be changed.

The following describes characteristic operations of lighting system 10 having the above-described configuration, with reference to FIG. 7 to FIG. 9C.

Figure 7:
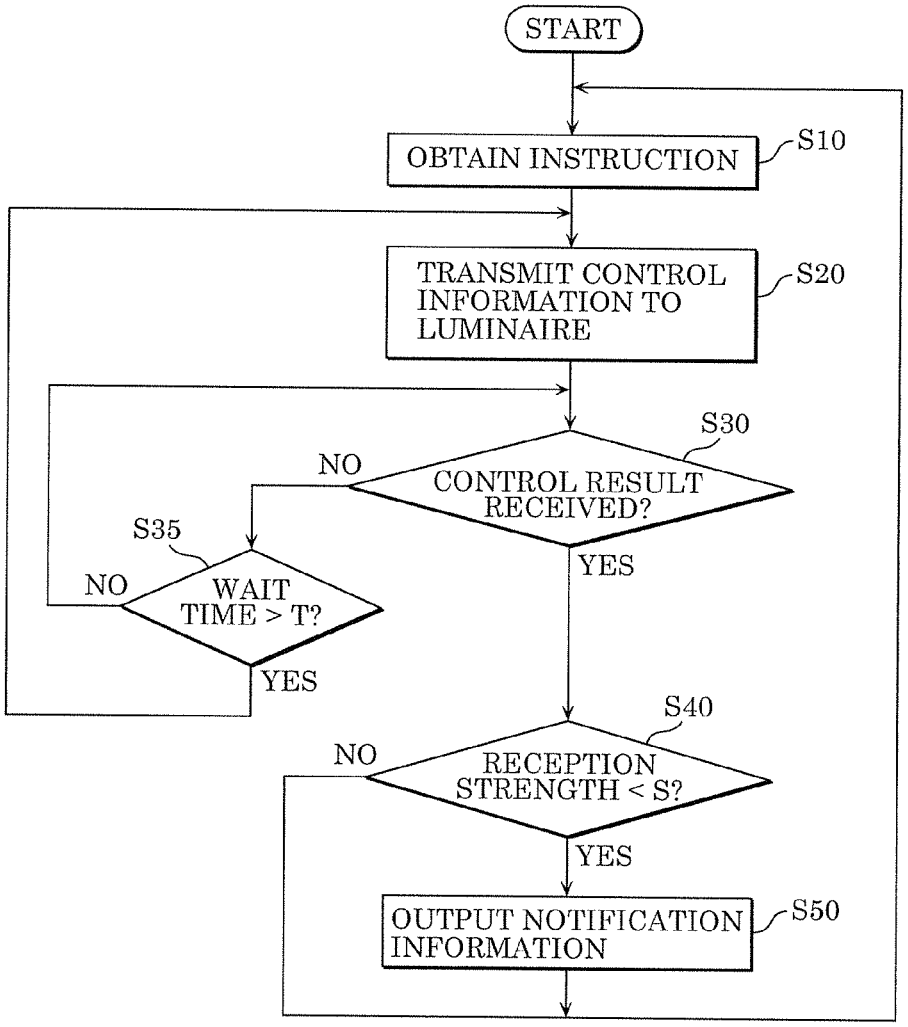
FIG. 7 is a flowchart which illustrates an example of an operation of the controller according to the embodiment.
Figure 8:
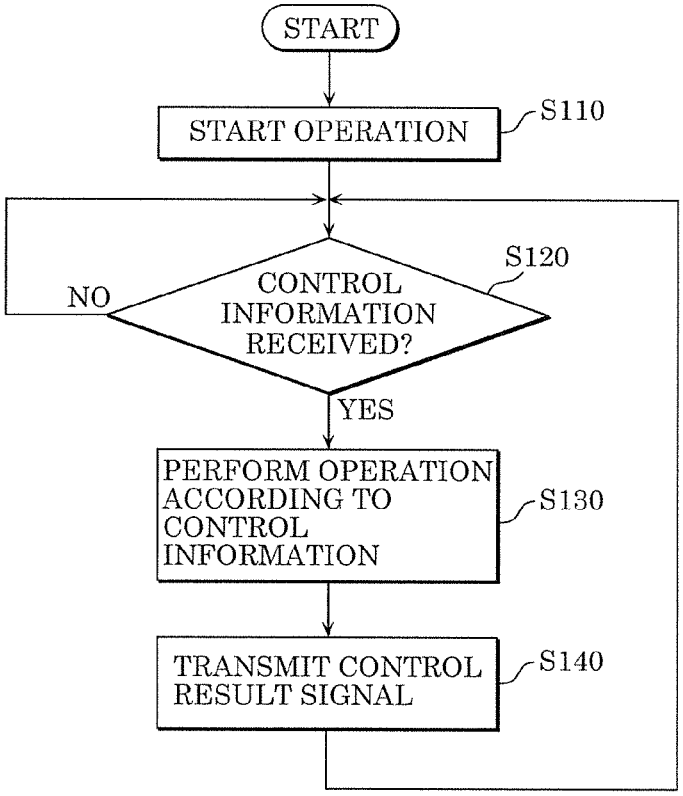
FIG. 8 is a flowchart which illustrates an example of an operation of the luminaire according to the embodiment.
Figure 9A:
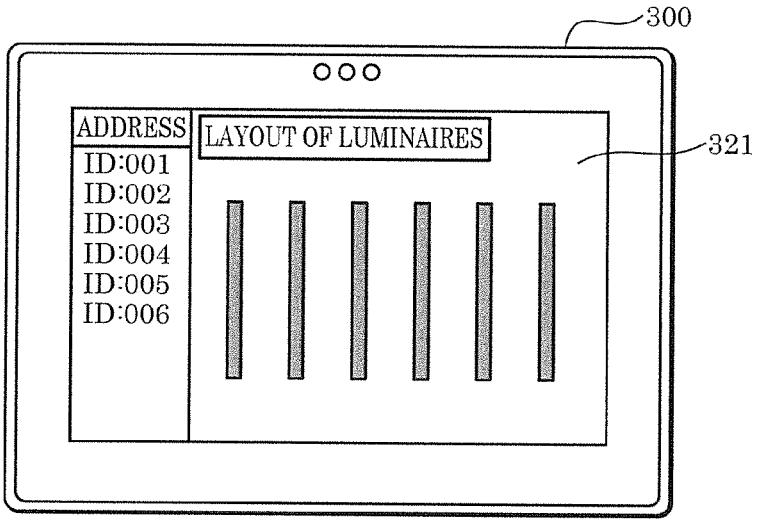
FIG. 9A is a diagram which illustrates a first example of a display screen of the controller according to the embodiment.
Figure 9B:
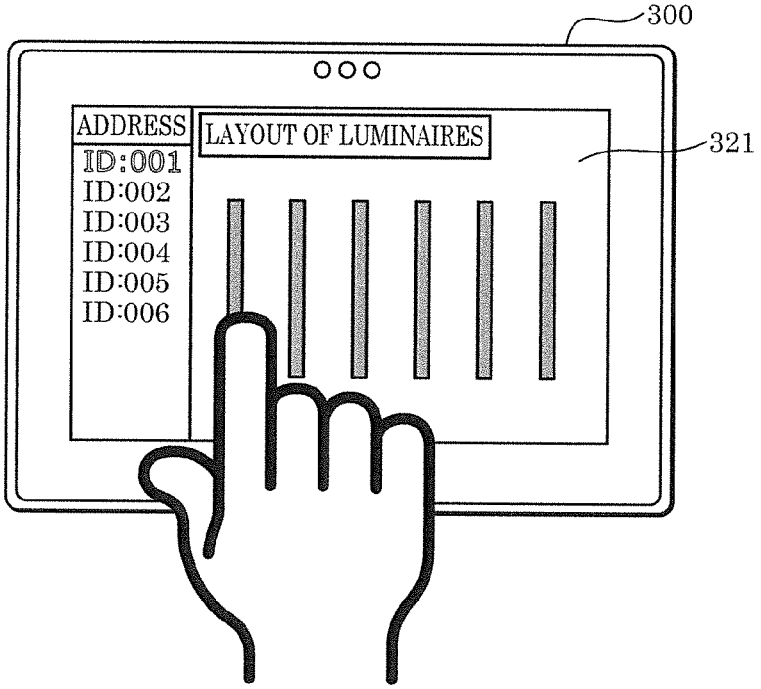
FIG. 9B is a diagram which illustrates a second example of a display screen of the controller according to the embodiment.
Figure 9C:
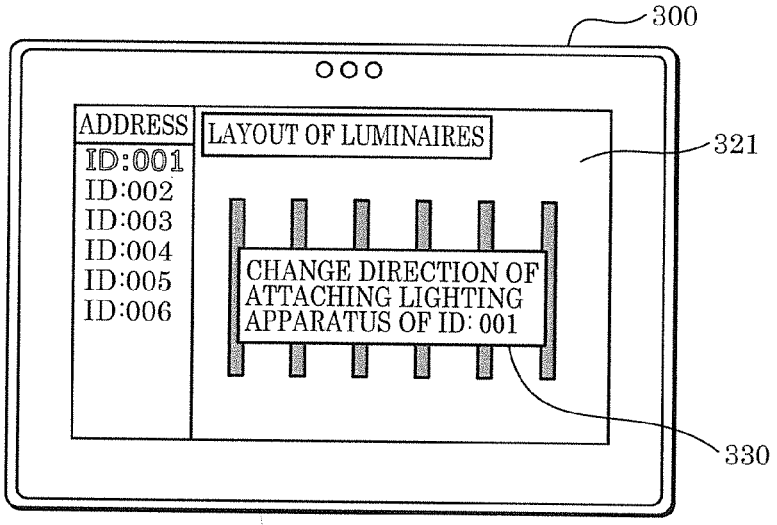
FIG. 9C is a diagram which illustrates a third example of a display screen of the controller according to the embodiment.

FIG. 7 is a flowchart illustrating an example of an operation of controller 300 according to the embodiment. FIG. 8 is a flowchart illustrating an example of an operation of luminaire 100 according to the embodiment. FIG. 9A to FIG. 9C are diagrams each illustrating an example of a display screen on controller 300 according to the embodiment. It should be noted that each of FIG. 9A to FIG. 9C illustrates an example of a display screen when controller 300 includes touch panel 321 which displays information and receives an instruction from a user.

Controller 300 first obtains an instruction from a user as illustrated in FIG. 7 (S10). More specifically, for example, a layout screen of a plurality of luminaires 100 is displayed on touch panel 321 of controller 300, as illustrated in FIG. 9A. According to the embodiment, a unique address (001 to 006) is allocated to each of the six luminaires 100. In this state, for example, when a user selects leftmost luminaire 100 (address: 001) as illustrated in FIG. 9B, control communicator 310 obtains an instruction of the user (to select the luminaire having an address "001") via touch panel 321.

Control communicator 310 further transmits a control signal to one of luminaires 100 having the address "001" which is indicated by the instruction (S20).

It should be noted that the details of the control signal transmitted at this time are not specifically limited, and a control signal indicating "dimming rate of 50%", for example, is transmitted to luminaire 100 having the address "001". Alternatively, for example, a test control signal not including an instruction such as a dimming rate may be transmitted.

Luminaire 100 having the address "001", for example, starts to receive power supply as a result of a switch (not illustrated) of a main power supply of controller 300 being turned on, and is placed in an operation start state (for example, an initial state in which luminaire 100 emits light at a dimming rate of 100%) as illustrated in FIG. 8 (S110).

Subsequently, wireless communication circuit 130 of luminaire 100, when the control signal transmitted from controller 300 (S20 of FIG. 7) is received (Yes in S120), transmits the control signal to driving circuit 140. Driving circuit 140 of luminaire 100 adjusts power supplied to light emitter 120, according to an instruction (for example, "dimming rate of 50%") indicated by the control signal, thereby changing the dimming rate of light emitter 120 to 50% (S130). Driving circuit 140 further transmits, to wireless communication circuit 130, a control result signal which indicates that the control according to the control signal is completed. Wireless communication circuit 130 transmits the control result signal received from driving circuit 140 to controller 300 (S140).

Next, back to FIG. 7, when the control result signal is received from luminaire 100 having the address "001" (Yes in S30), control communicator 310 of controller 300 transmits the control result signal to determinator 320. More specifically, control communicator 310 transmits information (received signal strength indicator: RSSI) which indicates a reception strength of the control result signal, together with the control result signal, to determinator 320.

In the case where a duration time (latency time) of the state in which a control result signal is not received (No in S30) after the transmitting of the control signal (S20) exceeds a predetermined period of time T (Yes in S35), control communicator 310 retransmit the control signal.

Determinator 320 compares the reception strength of the control result signal indicated by the RSSI received from control communicator 310 with threshold S held in, for example, a storage (not illustrated) of a semiconductor memory or the like. When the result of the comparing indicates that the reception strength is less than threshold S (Yes in S40), control communicator 310 outputs notification information which indicates that the orientation of lighting apparatus 110 of luminaire 100 having the address "001" is to be changed.

As a result, a notification screen indicating, as illustrated in FIG. 9C for example, "Please change the direction of attaching the lighting apparatus having the ID of 001" is displayed on touch panel 321 of controller 300 (S50).

When the notification screen is displayed on controller 300, a user changes the direction of attaching lighting apparatus 110 of luminaire 100 having the address of "001". More specifically, for example, luminaire 100 having the address of "001" is changed from the state illustrated in FIG. 3B to the state illustrated in FIG. 4B. In this manner, for example, the relative position of wireless communication circuit 130 included by luminaire 100 having the address of "001" with respect to controller 300 is changed. Subsequently, for example, the processes indicated in FIG. 7 and FIG. 8 are carried out as a result of a user reselecting the leftmost luminaire 100 (address: 001) using touch panel 321, and it is confirmed that there is no problem in the reception strength of the signal transmitted from luminaire 100 having the address of "001" as a result of a notification screen not being displayed on touch panel 321. It should be noted that, when the reception strength of the signal is greater than or equal to threshold S (No in S40 of FIG. 7), determinator 320 may cause touch panel 321 to display a notification screen which indicates that there is no problem in the reception strength.

The confirmation of a reception strength (confirmation of a communication state) as described above can be performed for each of the six luminaires 100, and thus a user can change the direction of attaching lighting apparatus 110 of each of the six luminaires 100 as necessary.

It should be noted that the various functions of controller 300 may be achieved by software, such as a program executed on a computer which includes, for instance, a central processing unit (CPU), read only memory (ROM), and a communication interface, or may be achieved by hardware such as an electronic circuit.

Here, when the six luminaires 100 are arranged as illustrated in FIG. 5, it may be considered that lighting apparatuses 110 of the six luminaires 100 each may be attached to corresponding apparatus body 200 in an orientation that wireless communication circuit 130 faces controller 300 (i.e., in an orientation that wireless communication circuit 130 is placed at an end of lighting apparatus 110 on the plus side of axis Y).

However, there are instances where a causal factor that deteriorates the communication state is present in a room in which lighting system 10 is installed, such as the case where: a pillar or a wall is present; tall furniture and fixtures are disposed; radio waves come into the room from outside, and the like. In addition, in consideration of reflection of radio waves on a wall surface, a shape or the like of the wall surface is also concerned with the communication state. In other words, it is not always the case that the shorter linear distance between wireless communication circuit 130 and luminaire 100 is more advantageous for communication.

In this regard, as described above, with lighting system 10 according to the embodiment, controller 300 is capable of quantitatively determining the communication state with each of luminaires 100, by measuring a reception strength of a control result signal obtained in response to a control signal. In addition, when it is determined that the communication state is poor (when the reception strength is less than threshold S), it is possible to notify a user that a direction of attaching lighting apparatus 110 of luminaire 100 corresponding to the reception strength is to be changed. This allows the user to improve the communication state between luminaire 100 corresponding to the notification and controller 300, by only performing an easy operation of changing the direction of attaching lighting apparatus 110 to apparatus body 200.

It should be noted that the number of luminaires 100 included in lighting system 10 is not specifically limited. Lighting system 10 only needs to include at least one luminaire 100. For example, even when lighting system 10 includes only one luminaire 100, controller 300 appropriately determines the communication state between luminaire 100 and controller 300, making it possible to facilitate improvement of the communication state.

Advantageous Effects, Etc

As described above, luminaire 100 according to the present embodiment includes: lighting apparatus 110 which includes wireless communication circuit 130 and light emitter 120 of which a light emitting state is controlled based on a control signal received by wireless communication circuit 130; and apparatus body 200 to which lighting apparatus 110 is detachably attached in different orientations According to this configuration, for example, it is possible to easily change the orientation of lighting apparatus 110 (i.e., to easily change the direction of attaching lighting apparatus 110) after apparatus body 200 is fixed to a ceiling or the like. In addition, a relative position or an orientation of wireless communication circuit 130 of lighting apparatus 110 in apparatus body 200 is changed by changing the orientation of lighting apparatus 110. In this manner, when the communication state between wireless communication circuit 130 and a source device of a control signal is poor, it is possible to improve the communication state by changing the orientation of lighting apparatus 110.

Here, a configuration in which a position of wireless communication circuit 130 in lighting apparatus 110 is made variable so as to improve the communication state is potentially employed. In this case, however, disposing wireless communication circuit 130 on the outer side of lighting apparatus 110 and apparatus body 200 is advantageous in view of the easiness of changing the position of wireless communication circuit 130. On the other hand, this can pose a problem of, for example, blocking illumination light by wireless communication circuit 130, impairing aesthetic appearance of luminaire 100 by wireless communication circuit 130, etc.

In addition, when assuming that a configuration which allows a position of wireless communication circuit 130 to be changed inside lighting apparatus 110 is employed, changing the position of wireless communication circuit 130 requires, for example, disassembling work such as detaching cover 180 from base 190. In other words, complication of work for changing a position of wireless communication circuit 130 is increased.

In this regard, for luminaire 100 according to the embodiment, a configuration in which the position of wireless communication circuit 130 disposed inside lighting apparatus 110 is fixed, lighting apparatus 110 is detachable from device body 200, and the orientation of lighting apparatus 110 with respect to device body 200 can be changed is employed. For that reason, it is possible to easily change the position of wireless communication circuit 130 in luminaire 100. In addition, this configuration is less likely to pose the problem of impairing the external appearance of wireless communication circuit 130, the problem of blocking illumination light by wireless communication circuit 130, etc.

As described above, luminaire 100 according to the embodiment includes lighting apparatus 110 having a wireless communication function, and with luminaire 100 according to the embodiment, it is possible to improve the communication state.

In addition, according to the embodiment, lighting apparatus 110 includes a lighting-apparatus-side engage portion, and apparatus body 200 includes a plurality of apparatus-body-side engage portions disposed at different positions, each of the plurality of apparatus-body-side engage portions being shaped to enable engagement with the lighting-apparatus-side engage portion.

More specifically, lighting apparatus 110 includes two engaging claws 165 and two engaging springs 160 each of which is the lighting-apparatus-side engage portion. In addition, apparatus body 200 includes two engaging holes 175*a* and two engaging holes 170*a* each of which is the apparatus-body-side engage portion. In addition, the two engaging claws 165 engage with the two engaging holes 175*a*, and the two engaging springs 160 engage with the two engaging holes 170*a*. As described above, an engaging mechanism is used in attaching lighting apparatus 110 to apparatus body 200, thereby making it possible, for example, to change the orientation of lighting apparatus 110 with respect to apparatus body 200 (i.e., to change the direction of attaching) without using a tool such as a driver, or the like.

In addition, according to the embodiment, lighting apparatus 110 includes N lighting-apparatus-side engage portions which include the lighting-apparatus-side engage portion, N being an integer greater than or equal to 2, apparatus body 200 includes at least N+1 apparatus-body-side engage portions which include the plurality of apparatus-body-side engage portions, and the at least N+1 apparatus-body-side engage portions are disposed at positions in apparatus body 200 such that a plurality of sets of N apparatus-body-side engage portions that engage with the N lighting-apparatus-side engage portions are selected from among the at least N+1 apparatus-body-side engage portions.

More specifically, as described with reference to FIG. 3A to FIG. 4B, lighting apparatus 110 includes four lighting-apparatus-side engage portions (two engaging claws 165 and two engaging springs 160). Apparatus body 200 includes eight apparatus-body-side engage portions (i.e., two engaging holes 175*a*, two engaging holes 170*a*, two engaging holes 175*b*, and two engaging holes 170*b*). In addition, two sets of four apparatus-body-side engage portions which engage with the two engaging claws 165 and the two engaging springs 160 included by lighting apparatus 110 can be selected. In other words, as illustrated in FIG. 3A and FIG. 3B, it is possible to select a pattern in which the two engaging claws 165 and the two engaging springs 160 included in lighting apparatus 110 engage with the two engaging holes 175*a* and the two engaging holes 170*a*, respectively. In addition, as illustrated in FIG. 4A and FIG. 4B, it is possible to select a pattern in which the two engaging claws 165 and the two engaging springs 160 included in lighting apparatus 110 engage with the two engaging holes 175*b* and the two engaging holes 170*b*, respectively.

In this manner, according to the embodiment, apparatus body 200 includes a larger number of apparatus-body-side engage portions than the lighting-apparatus-side engage portions included in lighting apparatus 110, thereby making it possible to change the orientation of lighting apparatus 110 with respect to apparatus body 200. In other words for example, since it is possible to increase variations of the orientation of lighting apparatus 110 with respect to apparatus body 200 by increasing the number of the apparatus-body-side engage portions included in apparatus body 200, the number of the variations of the orientation can be easily increased.

It should be noted that the number of the apparatus-body-side engage portions need not necessarily be larger than the number of the lighting-apparatus-side engage portions. For example, the case where lighting apparatus 110 includes two lighting-apparatus-side engage portions having the same shape, and apparatus body 200 includes two apparatus-body-side engage portions capable of respectively engaging with the two lighting-apparatus-side engage portions is assumed. In addition, the case where the two lighting-apparatus-side engage portions are symmetrically positioned with respect to axis P (see, for example, FIG. 3A and FIG. 3B), and the two apparatus-body-side engage portions are positioned to face the two lighting-apparatus-side engage portions when lighting apparatus 110 is attached to apparatus body 200 is assumed. In this case, it is possible to change the orientation of lighting apparatus 110 with respect to apparatus body 200, by changing the counterpart of engagement of each of the two lighting-apparatus-side engage portions from one of the two apparatus-body-side engage portions to the other. In addition, it is possible to prevent the illumination space created by luminaire 100 from substantially changing after the change of the orientation.

For example, it is possible to change the orientation of lighting apparatus 110 by 180 degrees, by disposing the lighting-apparatus-side engage portions at both end portions of lighting apparatus 110 in the longitudinal direction (the direction of axis X) and disposing the apparatus-body-side engage portions at both end portions of apparatus body 200 in the longitudinal direction (the direction of axis X).

In addition, according to the embodiment, light emitter 120 includes substrate 121 and a plurality of light emitting elements 122 disposed on substrate 121, an orientation of lighting apparatus 110 on apparatus body 200 is changeable by a predetermined angle in a rotational direction about a predetermined axis passing through apparatus body 200 in a plan view, and the plurality of light emitting elements 122 are disposed at positions in lighting apparatus 110 such that the plurality of light emitting elements 122 are rotationally symmetric by the predetermined angle about axis P.

According to the embodiment, it is possible to change the orientation of lighting apparatus 110 by 180 degrees as described above, and the plurality of light emitting elements 122 are arranged at positions that are rotationally symmetric by every 180 degrees about axis P.

With the above-described configuration, even when the orientation of lighting apparatus 110 with respect to apparatus body 200 is changed so as to improve the communication state, for example, it is possible to cause the illumination space created by luminaire 100 to be substantially the same before and after the change of the orientation. In other words, even when the direction of attaching lighting apparatus 110 is changed so as to improve the communication state, there is no change in, for example, distribution of illumination light from luminaire 100, and thus lighting effects, for example, are not diminished.

In addition, lighting system 10 according to the present embodiment includes: luminaire 100; and controller 300 which transmits the control signal to luminaire 100. In lighting system 10 according to the present embodiment, controller 300 includes: control communicator 310 which wirelessly communicates with luminaire 100; and determinator 320 which outputs notification information indicating that an orientation of lighting apparatus 110 in luminaire 100 is to be changed, when a reception strength of a signal transmitted from luminaire 100 and received by control communicator 310 is less than a threshold.

According to the embodiment, specifically, a notification screen for notifying a user that the orientation of lighting apparatus 110 is to be changed is displayed on touch panel 321 of controller 300, as illustrated in FIG. 9C.

In this manner, controller 300 is capable of determining whether or not to change the orientation of lighting apparatus 110 on the basis of a reception strength of a signal transmitted from luminaire 100. For that reason, the condition of the communication state between controller 300 and luminaire 100 which is difficult to visually determine is appropriately determined, and a user can change the orientation of lighting apparatus 110 in luminaire 100 according to the determination. In other words, with lighting system 10 according to the embodiment, it is possible to easily improve the communication state of luminaire 100 included in lighting system 10.

It should be noted that, in luminaire 100 according to the embodiment, the orientation of lighting apparatus 110 can be changed by 180 degrees, as described above. In other words, the orientation of lighting apparatus 110 with respect to apparatus body 200 (the disposed location of wireless communication circuit 130) has two variations. However, three or more variations of the orientation of the lighting apparatus with respect to the apparatus body may exist. In view of the above, as a variation of the embodiment, a luminaire including a lighting apparatus which can assume four different orientations with respect to the apparatus body will be described. It should be noted that, in the variation below, the difference from the above-described embodiment will be mainly described.

(Variation)

Figure 10:
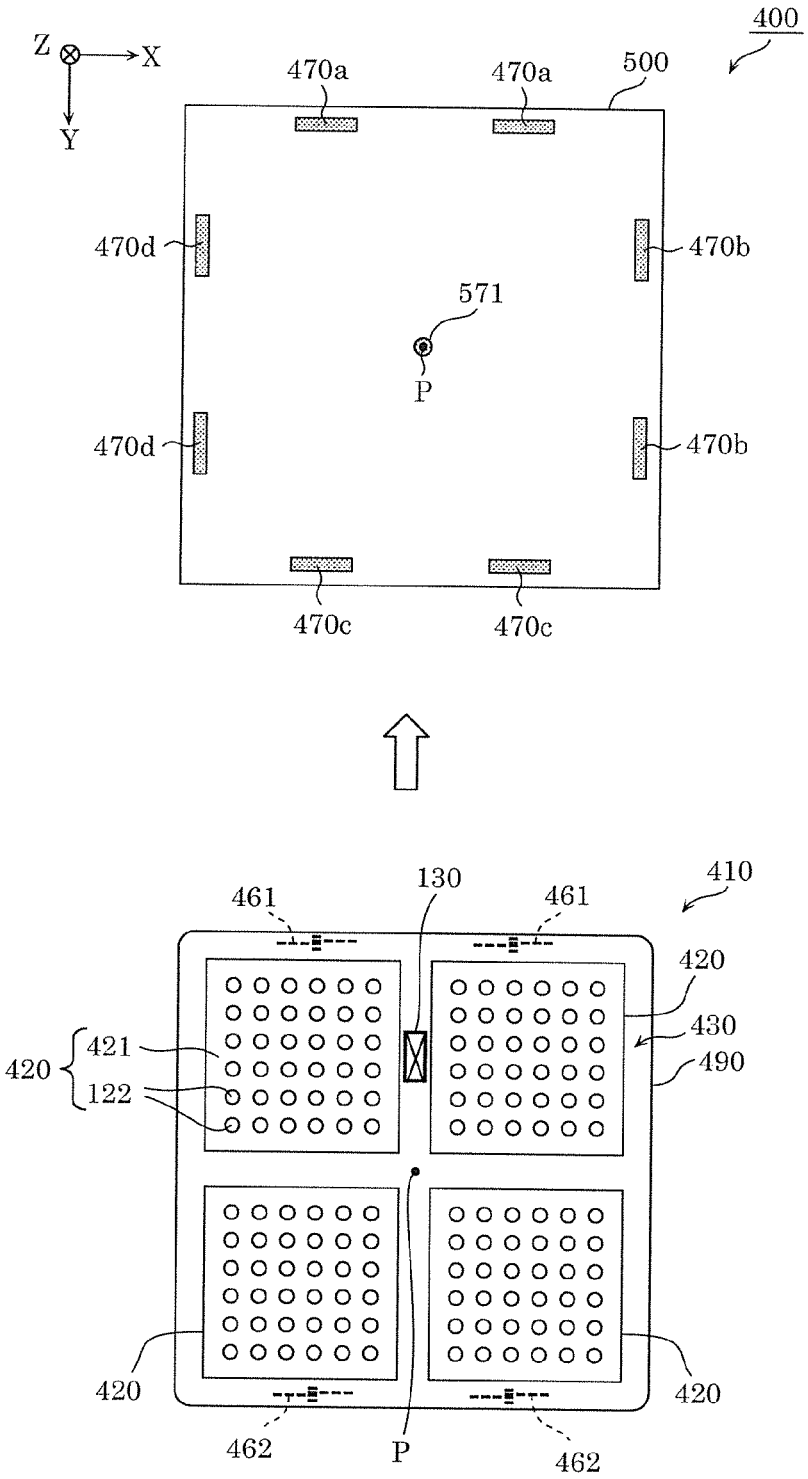
FIG. 10 is a plan view which illustrates a schematic configuration of a luminaire according to a variation of the embodiment.

FIG. 10 is a plan view which illustrates a schematic configuration of luminaire 400 according to a variation of the embodiment. FIG. 11A to FIG. 11D are diagrams each of which illustrates a variation of an orientation of lighting apparatus 410 according to the variation of the embodiment.

It should be noted that, in FIG. 10, apparatus body 500 and lighting apparatus 410 are separated, and the configuration of each of apparatus body 500 and lighting apparatus 410 is simply illustrated. In addition, in lighting apparatus 410, engaging springs 461 and 462 disposed on a rear surface of base 490 are illustrated by dashed lines, and wireless communication circuit 130 disposed on the rear surface of base 490 is illustrated by a bold line for clarifying the position of wireless communication circuit 130. Moreover, structural components such as the driving circuit, cover, etc. which are included in lighting apparatus 410 are omitted from the illustration in FIG. 10. These explanatory items regarding FIG. 10 described above are also applied to FIG. 11A to FIG. 11D.

Luminaire 400 according to the present variation includes lighting apparatus 410 which includes wireless communication circuit 130 and light emitter 430 of which a light emitting state is controlled based on a control signal received by wireless communication circuit 130; and apparatus body 500 to which lighting apparatus 410 is detachably attached in different orientations. Light emitter 430 according to the present variation includes four sub light emitters 420. Each of the four sub light emitters 420 includes substrate 421 and a plurality of light emitting elements 122 disposed on substrate 421. In other words, light emitter 430 includes four substrates 421 and a plurality of light emitting elements 122.

Light emitter 430 is fixed to base 490 included in lighting apparatus 410. A power line (not illustrated) drawn out from opening portion 571 of apparatus body 500 is electrically connected to the driving circuit of lighting apparatus 410, and light emitter 430 emits light using DC power supplied from the driving circuit. As described above, luminaire 400 according to the present variation has a basic configuration that is common to luminaire 100 according to the above-described embodiment.

Luminaire 400 according to the present variation is different from luminaire 100 according to the above-described embodiment in that luminaire 400 is square (including the case of a substantially square) in a plan view, and the orientation of lighting apparatus 410 can be changed by 90 degrees in a rotational direction about axis P. It should be noted that axis P is a virtual axis which passes through the center of apparatus body 500 and the center of lighting apparatus 410 in a plan view, and is parallel to axis Z.

More specifically, lighting apparatus 410 includes four lighting-apparatus-side engage portions provided to base 490. According to the present variation, lighting apparatus 410 includes two engaging springs 461 and two engaging springs 462 as the four lighting-apparatus-side engage portions. Apparatus body 500 includes eight apparatus-body-side engage portions (two engaging holes 470*a*, two engaging holes 470*b*, two engaging holes 470*c*, and two engaging holes 470*d*). It should be noted that each of the engaging holes is illustrated as a dotted rectangle in FIG. 10.

Each of the four engaging springs (461 and 462) of lighting apparatus 410 is a spring component which is called a torsion spring or the like. The four engaging springs are respectively inserted into the engaging holes (470*a* to 470*d*) in a state in which the width (the width in the direction of axis X in FIG. 10) is compressed, and subsequently the width is expanded due to elastic force (restoring force). With this configuration, each of the four engaging springs (461 and 462) engages with a corresponding one of the engaging holes. In addition, when lighting apparatus 410 is pulled toward the front side (i.e., the minus side of axis Z), each of the four engaging springs (461 and 462) is compressed due to elastic deformation, and pulled out from a corresponding one of the engaging holes. In this manner, it is possible to detach lighting apparatus 410 from apparatus body 500.

Since luminaire 400 according to the present variation has the above-described configuration, four sets of four apparatus-body-side engage portions (engaging holes) which engage with two engaging springs 461 and two engaging springs 462 included in lighting apparatus 410 can be selected. In other words, there are four variations of the orientation of lighting apparatus 410 in luminaire 400, as illustrated in FIG. 11A to FIG. 11D.

Figure 11A:
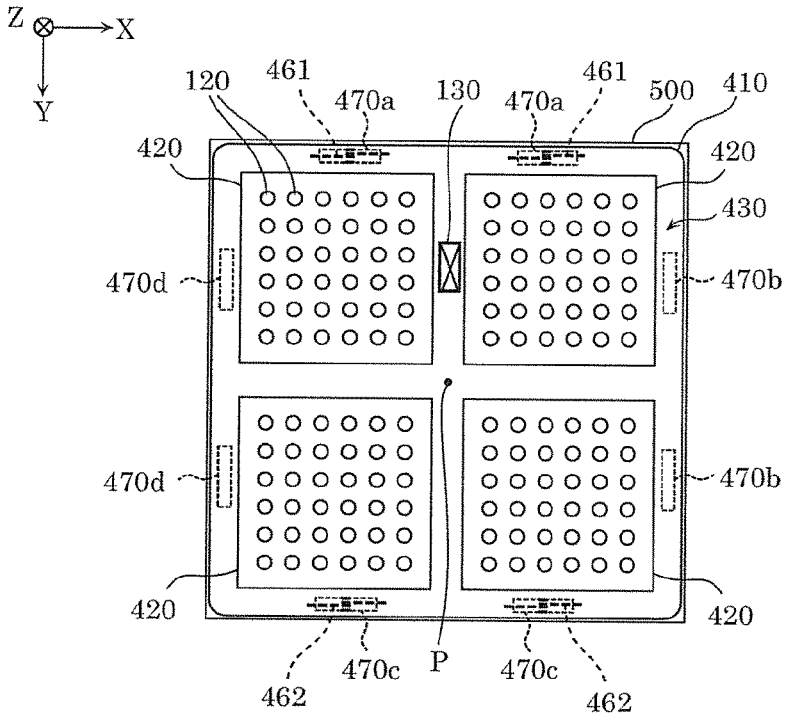
FIG. 11A is a diagram which illustrates a first orientation of the lighting apparatus according to the variation of the embodiment.

More specifically, as illustrated in FIG. 11A, the two engaging springs 461 of lighting apparatus 410 engage with the two engaging holes 470*a* of apparatus body 500, and the two engaging springs 462 of lighting apparatus 410 engage with the two engaging holes 470*c* of apparatus body 500, as illustrated in FIG. 11A. When lighting apparatus 410 is attached to apparatus body 500 in this state, wireless communication circuit 130 is positioned on the minus side of axis Y with respect to axis P.

Figure 11B:
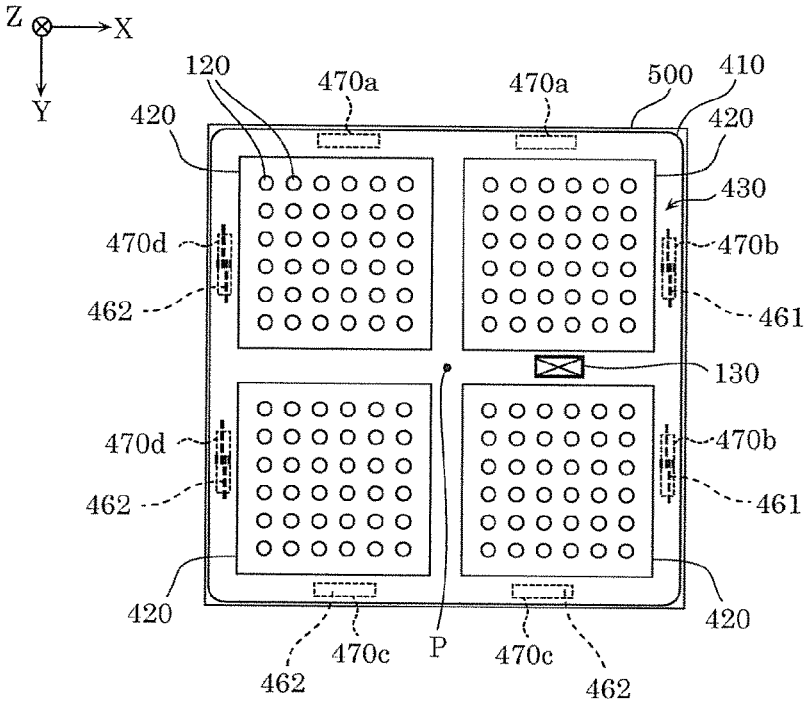
FIG. 11B is a diagram which illustrates a second orientation of the lighting apparatus according to the variation of the embodiment.

In addition, as illustrated in FIG. 11B, the two engaging springs 461 of lighting apparatus 410 engage with the two engaging holes 470*b* of apparatus body 500, and the two engaging springs 462 of lighting apparatus 410 engage with the two engaging holes 470*d* of apparatus body 500. When lighting apparatus 410 is attached to apparatus body 500 in this state, wireless communication circuit 130 is positioned on the plus side of axis X.

Figure 11C:
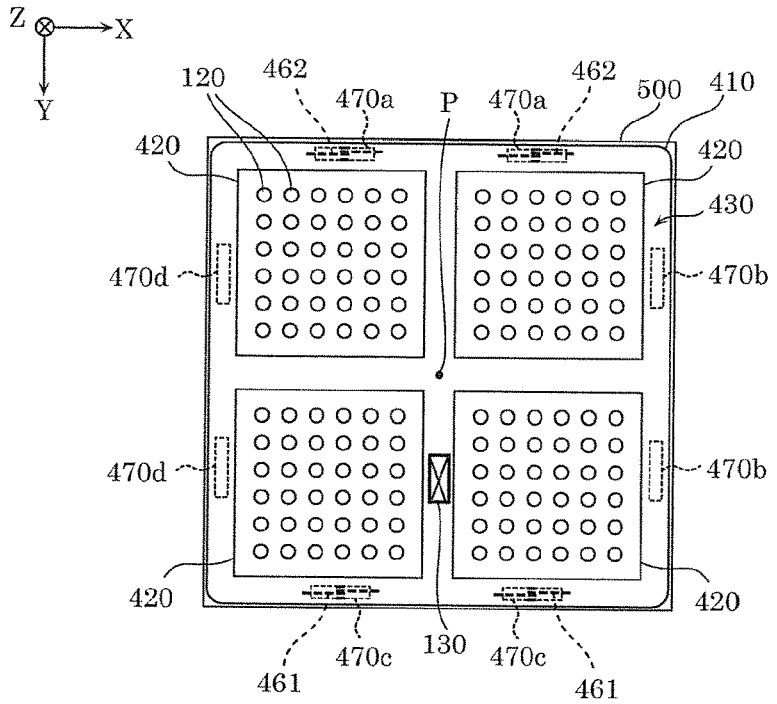
FIG. 11C is a diagram which illustrates a third orientation of the lighting apparatus according to the variation of the embodiment.

In addition, as illustrated in FIG. 11C, the two engaging springs 461 of lighting apparatus 410 engage with the two engaging holes 470*c* of apparatus body 500, and the two engaging springs 462 of lighting apparatus 410 engage with the two engaging holes 470*a* of apparatus body 500. When lighting apparatus 410 is attached to apparatus body 500 in this state, wireless communication circuit 130 is positioned on the plus side of axis Y.

Figure 11D:
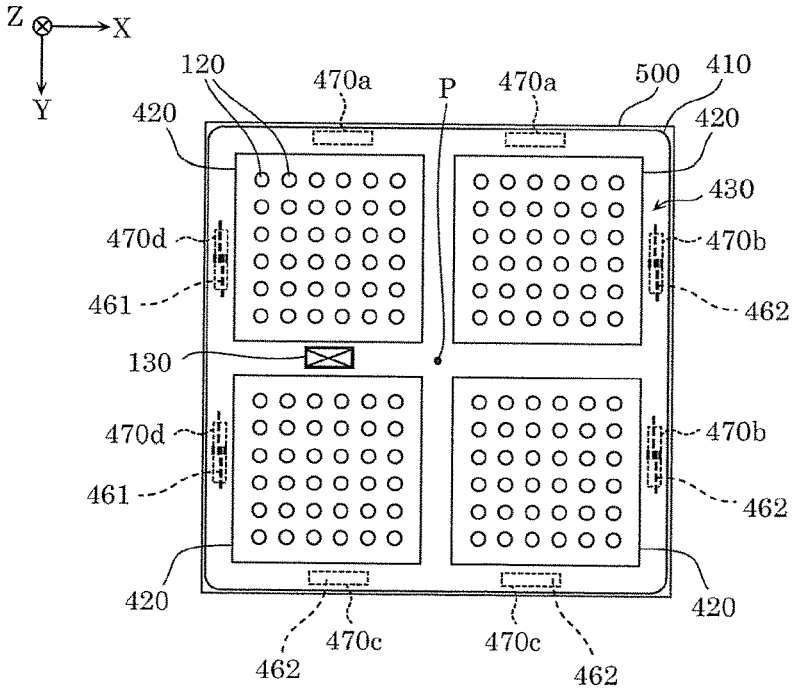
FIG. 11D is a diagram which illustrates a fourth orientation of the lighting apparatus according to the variation of the embodiment.

In addition, as illustrated in FIG. 11D, the two engaging springs 461 of lighting apparatus 410 engage with the two engaging holes 470*d* of apparatus body 500, and the two engaging springs 462 of lighting apparatus 410 engage with the two engaging holes 470*b* of apparatus body 500. When lighting apparatus 410 is attached to apparatus body 500 in this state, wireless communication circuit 130 is positioned on the minus side of axis X.

As described above, in luminaire 400 according to the present variation, lighting apparatus 410 may assume four orientations as the orientation with respect to apparatus body 500. In other words, there are four possible positions as a relative position, in luminaire 400, of wireless communication circuit 130 included in lighting apparatus 410. For that reason, the possibility of improvement in the communication state between wireless communication circuit 130 and a source device of a control signal (for example, controller 300) is increased.

In addition, according to the present variation, light emitter 430 includes a plurality of light emitting elements 122, and the orientation of lighting apparatus 410 can be changed by 90 degrees in the rotational direction about axis P in a plan view. The plurality of light emitting elements 122 are arranged in lighting apparatus 410 at positions that are rotationally symmetric by every 90 degrees about axis P.

With the above-described configuration, even when the orientation of lighting apparatus 410 with respect to apparatus body 500 is changed so as to improve the communication state, for example, it is possible to cause the illumination space created by luminaire 400 to be substantially the same before and after the change. In other words, even when the direction of attaching lighting apparatus 410 is changed so as to improve the communication state, there is no change in, for example, distribution of illumination light from luminaire 400, and thus lighting effects, for example, are not diminished.

It should be noted that, in the above-described embodiment and variation, luminaires 100 and 400 having a rectangular or squire shape in a plan view have been described. However, a luminaire which produces the above-described advantageous effects can be implemented as long as the luminaire includes a lighting apparatus having a shape that can be rotationally symmetric, such as an equilateral polygonal shape with n sides (n is an integer greater than or equal to 5), a circular shape, a star, an oval, etc., for example. In other words, it is possible to implement a luminaire including a lighting apparatus of which orientation with respect to the apparatus body can be changed, and capable of causing an illumination space created by the luminaire to be substantially the same before and after the change of the orientation. In addition, in this case, the shape of the apparatus body need not necessarily a shape that can be rotationally symmetric such as a regular polygon, a circular, etc, and it is sufficient that, for example, the plurality of apparatus-body-side engage portions disposed on the apparatus body are rotationally symmetric.

In addition, a lighting system which includes luminaire 400 and controller 300 according to the present variation may be configured. In this case, for example, controller 300 may measure, for one luminaire 400, a reception strength in each of four orientations, and output notification information for identifying an orientation with the best communication state (the highest reception strength) using the result of the measurement.

(Others)

The luminaire and the lighting system according to the present disclosure have been described based on the embodiment and the variations as above; however, the present disclosure is not limited to the above-described embodiment and variations.

For example, the lighting-apparatus-side engage portion which is an engaging spring or a engaging claw engages with the apparatus-body-side engage portion which is an engaging hole, according to the above-described embodiment or the variations. However, for example, the lighting-apparatus-side engage portion which is an engaging hole may engage with the apparatus-body-side engage portion which is an engaging spring, an engaging claw, or the like. In other words, to put it simply, the lighting apparatus may be attached to the apparatus body as a result of a protrusion of the apparatus body hooks onto a hole, an opening, or the like of the lighting apparatus.

In addition, controller 300 need not necessarily include a user interface such as touch panel 321. For example, controller 300 may receive an instruction of a user via a mobile terminal such as a smartphone, a tablet terminal, or the like, by communicating with the mobile terminal. In addition, the display screens illustrated in FIG. 9A to FIG. 9C may be displayed on the mobile terminal, to inform a user of various information items. In other words, the functions of a user interface which controller 300 is supposed to include may be included by other device such as a mobile terminal.

In addition, the notification information output by determinator 320 of controller 300 need not necessarily be displayed on the display panel as an image. For example, the notification information may be output as a sound. In addition, for example, controller 300 may transmit the notification information to luminaire 100 in which the orientation of lighting apparatus 110 needs to be changed, thereby causing luminaire 100 to blink.

In addition, although the foregoing embodiment describes the case where light emitting element 122 is an SMD LED element, the present disclosure is not limited to this example. For example, light emitter 120 or 430 may have a chip on board (COB) structure in which an LED chip is directly mounted on a substrate. In this case, a plurality of LED chips mounted on the substrate are collectively or separately sealed by a sealing member containing a wavelength converting material, thereby making it possible to obtain illumination light having a predetermined color temperature.

In addition, in the above-described embodiment and variations, an LED element including a packaged LED chip is exemplified as light emitting element 122. However, a semiconductor light-emitting element such as a semiconductor laser, or other types of a solid-state light-emitting element such as an organic electro luminescence (EL) and an inorganic EL may be employed as light emitting element 122.

It should be noted that the present disclosure also includes other forms in which various variations apparent to those skilled in the art are applied to the above-described embodiments and variations or forms in which structural components and functions in the above-described embodiment and variations are arbitrarily combined within the scope of the present disclosure.

While the foregoing has described one or more embodiments and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A luminaire, comprising:

a lighting apparatus which includes a wireless communication circuit which receives a control signal from a controller external to the luminaire and a light emitter of which a light emitting state is controlled based on the control signal received by the wireless communication circuit; and an apparatus body to which the lighting apparatus is detachably attached in different orientations, wherein a position of the wireless communication circuit relative to the apparatus body is changed by changing an orientation of the lighting apparatus relative to the apparatus body, the wireless communication circuit being fixed to the lighting apparatus.

2. The luminaire according to claim 1, wherein:

the lighting apparatus includes a lighting-apparatus-side engage portion, and the apparatus body includes a plurality of apparatus-body-side engage portions disposed at different positions, each of the plurality of apparatus-body-side engage portions being shaped to enable engagement with the lighting-apparatus-side engage portion.

3. The luminaire according to claim 2, wherein:

the lighting apparatus includes N lighting-apparatus-side engage portions which include the lighting-apparatus-side engage portion, N being an integer greater than or equal to 2, the apparatus body includes at least N+1 apparatus-body-side engage portions which include the plurality of apparatus-body-side engage portions, and the at least N+1 apparatus-body-side engage portions are disposed at positions in the apparatus body such that a plurality of sets of N apparatus-body-side engage portions that engage with the N lighting-apparatus-side engage portions are selected from among the at least N+1 apparatus-body-side engage portions.

4. The luminaire according to claim 2, wherein:
each of the plurality of apparatus-body-side engage portions is an opening defined in the apparatus body, and
the lighting-apparatus-side engage portion is one of an engaging claw which hooks onto the opening and an engaging spring which is inserted into the opening and then placed in a released state by restoring force.

5. The luminaire according to claim 2, wherein:
the lighting apparatus includes a set of lighting-apparatus-side engage portions disposed at opposing positions in a plan view,
the plurality of apparatus-body-side engage portions include a first set of apparatus-body-side engage portions and a second set of apparatus-body-side engage portions, and
the first set of apparatus-body-side engage portions and the second set of apparatus-body-side engage portions are disposed at positions to be rotationally symmetric to each other about a predetermined axis in a plan view.

6. The luminaire according to claim 1, wherein
the light emitter includes a substrate and a plurality of light emitting elements disposed on the substrate,
an orientation of the lighting apparatus on the apparatus body is changeable by a predetermined angle in a rotational direction about a predetermined axis passing through the apparatus body in a plan view, and
the plurality of light emitting elements are disposed at positions in the lighting apparatus such that the plurality of light emitting elements are rotationally symmetric by the predetermined angle about the predetermined axis.

7. The luminaire according to claim 1, wherein
the apparatus body includes an opening which is positioned at a center of the apparatus body in a plan view, and through which a power line connected to the lighting apparatus penetrates.

8. The luminaire according to claim 1, wherein
the wireless communication circuit is disposed at a position not overlapping a center of the lighting apparatus in a plan view.

9. The luminaire according to claim 1, wherein:
the lighting apparatus has an elongate shape in a plan view, and
the wireless communication circuit is disposed at an end portion of the lighting apparatus in a longitudinal direction.

10. The luminaire according to claim 1, wherein:
the lighting apparatus further includes a base having a front surface on which a light emitter is disposed, and
the wireless communication circuit is disposed on a rear surface of the base.

11. A lighting system, comprising:
the luminaire according to claim 1; and
a controller which transmits the control signal to the luminaire, wherein
the controller includes:
a control communicator which wirelessly communicates with the luminaire; and
a determinator which outputs notification information indicating that an orientation of the lighting apparatus in the luminaire is to be changed, when a reception strength of a signal transmitted from the luminaire and received by the control communicator is less than a threshold.

12. The lighting system according to claim 11, wherein:
the controller further includes a receiver which receives an instruction from a user,
the control communicator
(i) when the receiver receives an instruction to select the luminaire, transmits the control signal to the luminaire, and
(ii) after transmitting the control signal, receives a control result signal based on the control signal, from the luminaire, and
the determinator outputs the notification information indicating that the orientation of the lighting apparatus in the luminaire is to be changed, when a reception strength of the control result signal received by the control communicator is less than a threshold.

13. The lighting system according to claim 11, wherein
the determinator further outputs notification information indicating that the reception strength is acceptable, when the reception strength of the signal transmitted from the luminaire and received by the control communicator is greater than or equal to the threshold.

14. The lighting system according to claim 12, wherein:
the receiver includes a touch panel which displays information and receives an instruction from a user, and
when the determinator outputs the notification information, the touch panel displays a screen indicating the notification information.

* * * * *